United States Patent [19]

Schwaner

[11] 4,251,020

[45] Feb. 17, 1981

[54] INTEGRAL CORRUGATED PARTITION

[75] Inventor: Jon M. Schwaner, Indianapolis, Ind.

[73] Assignee: Inland Container Corporation, Indianapolis, Ind.

[21] Appl. No.: 116,535

[22] Filed: Jan. 29, 1980

[51] Int. Cl.[3] ..... B65D 5/48

[52] U.S. Cl. ..... 229/15

[58] Field of Search ..... 229/15, 42

[56] References Cited

U.S. PATENT DOCUMENTS

| | | | |
|---|---|---|---|
| 3,301,460 | 1/1967 | Harrison | 229/15 |
| 3,738,561 | 6/1973 | Nederveld | 229/15 |
| 4,030,660 | 6/1977 | Rada et al. | 229/15 |
| 4,127,304 | 11/1978 | Gardner | 229/15 |
| 4,136,815 | 1/1979 | Gardner | 229/15 |
| 4,143,804 | 3/1979 | Visvydas | 229/15 |
| 4,148,428 | 4/1979 | Gardner | 229/15 |

*Primary Examiner*—Davis T. Moorhead

*Attorney, Agent, or Firm*—Fitch, Even, Tabin, Flannery & Welsh

[57] ABSTRACT

A single die-cut and scored sheet defines a plurality of cells of equal dimensions. The sheet is easily and quickly erected into a partition which, when inserted into an RSC, divides the box into precisely located cells that are adapted for automatic loading. Partitions for packaging 6 items and 3 items are shown.

10 Claims, 6 Drawing Figures

INTEGRAL CORRUGATED PARTITION

This invention relates to partitions for dividing containers into a plurality of cells and more particularly to an integral, die-cut and scored blank which can be erected into an internal partition for dividing a container of rectangular cross section into a plurality of cells.

BACKGROUND OF THE INVENTION

Paperboard partitions of both one-piece and multiple-piece design have long been employed to divide the interior region of a rectangular box or container into a plurality of cells, which are usually of equal size but which could be of varying size if desired. Multiple-piece design partitions, particularly those which would attempt to utilize the cushioning characteristic of corrugated fiberboard, have generally required hand assembly and have not been susceptible to machine loading. One-piece design partitions have been developed which create a plurality of cells of equal dimension; however, such designs have not proved totally successful from the standpoint of providing a compartmented container which can be filled by automatic loading equipment.

SUMMARY OF THE INVENTION

This invention provides an erectable, internal partition which is formed from a single die-cut and scored sheet of paperboard, preferably corrugated fiberboard. The preferred erected partition has ten panels which can be simply folded into an erect internal partition that will divide a rectangular container into a plurality of cells of equal size. The ten panels are of equal height and, by proportioning the height to the depth of the container, additional stacking strength can be added to the overall package. An important feature of the partition is that its design renders it particularly well-suited for the provision of compartmented containers which can be filled by automatic loading equipment because the individual cells are precisely positioned within the otherwise empty container. An alternative partition, which is in essence one-half of the preferred partition, provides three cells of equal dimension that are also precisely positioned within a rectangular container.

DETAILED DESCRIPTION OF THE PREFERRED EMBODIMENTS

Figure 1:
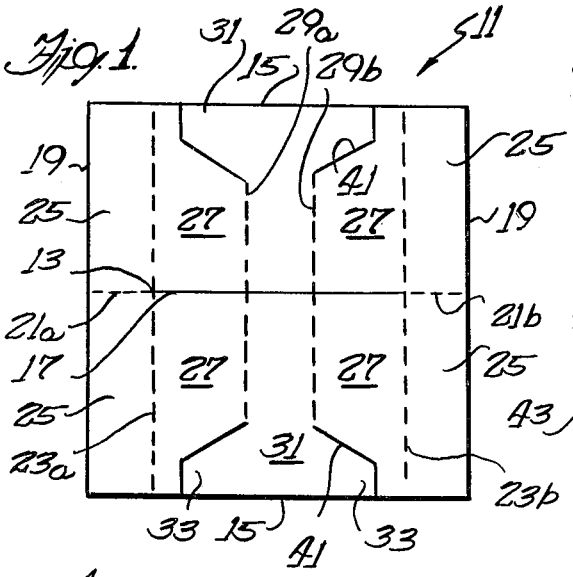
FIG. 1 is a plan view of a blank of foldable sheet material from which an internal partition can be easily and simply erected.
Figure 3:
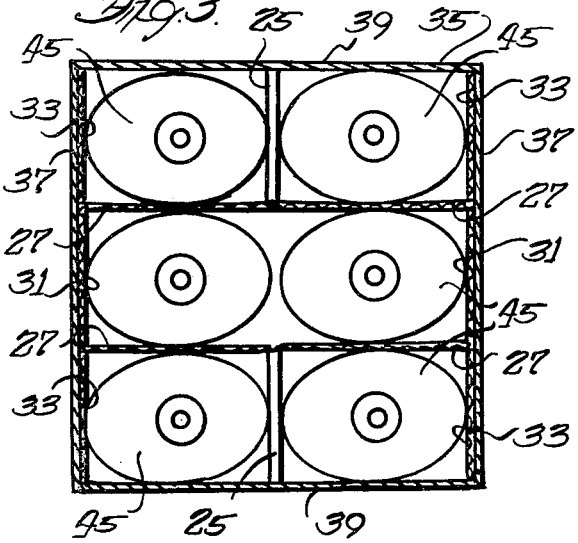
FIG. 3 is a plan view of a container into which the partition of FIG. 2 has been disposed and into which six objects of equal size and dimension have been loaded.

Shown in FIG. 1 is a blank 11 which has been die-cut and scored from a sheet of corrugated single-wall fiberboard. Although corrugated fiberboard is preferred, other sheet material might be used, for example, chipboard. The flutes of the corrugations preferably run vertically in the orientation of FIG. 1 and will also run vertical when the partition is installed in a container as depicted in FIG. 3.

The blank 11 is divided into upper and lower halves by a central line of demarcation 13 that is equidistant from the upper and lower parallel edges 15. The center portion of the central line is created by a straight-line die-cut 17 which terminates an equal distance short of each of the opposite vertical edges 19 but which is continued by co-linear score lines 21*a* and *b* which extend to the edges. The die-cut line 17 could extend a short distance into the region of the score lines 21*a* and *b* if desired.

The upper and lower halves of the blank 11 are mirror images of each other and are formed into five panels each by four parallel score lines which are perpendicular to the central line of demarcation 13. The outward two score lines 23*a* and *b* extend completely across the blank from edge to edge and define four panels 25 of equal size which are hinged together in pairs along the score lines 21*a* and *b* that, as can be seen from FIG. 2, form the upper edges of the panels in the erected partition. It should be understood that the description herein is provided on the basis of the depicted orientation that is the preferred orientation in which the partition would be employed. However, some advantages of the invention could be obtained if the partition were used in an upside-down orientation.

Four additional panels 27, referred to as transverse panels, are respectively hinged by the score lines 23*a* and *b*, one to each of the panels 25. In the erected partition, the transverse panels 27 are arranged perpendicular to the panels 25 which, as can be seen, have been folded into pairs with their facing surfaces in abutting contact. The other side edges of each of the transverse panels 27 are partially defined by score lines 29*a* and *b* along which they are hinged to parallel edges of two main panels 31. In the erected partition, the main panels 31 are oriented parallel to the panels 25.

Figure 2:
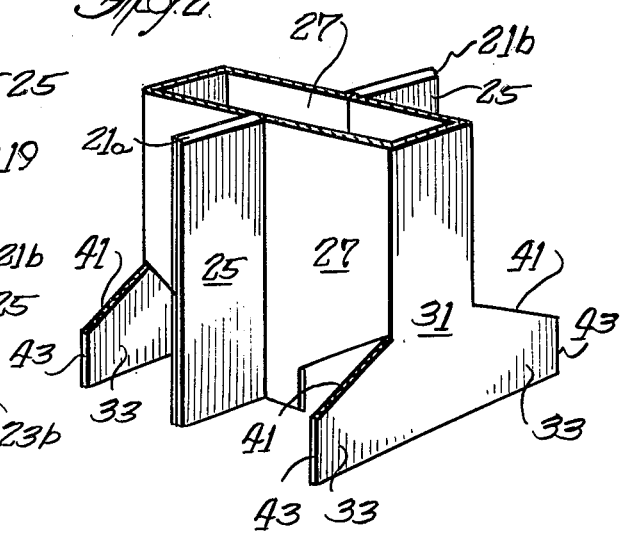
FIG. 2 is a perspective view of a partition erected from the blank shown in FIG. 1.

As best seen in FIG. 2, all of the panels are of equal height, and the length of the first four panels 25 is the same and is essentially the length of the hinge line 21, although as earlier indicated, the hinge line need not extend for the full length of the panels so long as there is an adequate hinge attachment. The length of the transverse panels 27 is longer than the panels 25 and is preferably at least equal to the length of the first panels 25 because cut from the lower portions of the transverse panels are a pair of wings 33 which constitute a part of the main panels 31.

As best seen in FIG. 3, the wings 33 are equal in length to the first panels 25 and thus aid in precisely defining the cells when the partition is disposed within a container 35. The main panels 31 each lie adjacent one of the end walls 37 of a rectangular box or container 35 and thus position the attached, hinged edges of the transverse panels 27 precisely within the box. The inherent resiliency of corrugated fiberboard to attempt to return to its shape in the flat blank causes the folded-over pairs of first panels 25 to tend to press against the side walls 39 of the box. Accordingly, because the first panels 25 and the wings 33 are of the same length, the transverse panels 27 are positioned precisely parallel to the side walls 39 even when the box 35 is empty of all else but the internal partition.

The wings 33 are preferably defined by diagonal die-cuts 41 which extend downward and outward from the ends of the score lines 29*a,b* to a pair of vertical edges 43 which are also die-cut from the blank 11. The hinge lines between the main panels 31 and the transverse panels 27 which are provided by the score lines 29 in the blank 11 preferably extend for at least half the height of the partition so that the wings are located in the lower region and do not detract from the overall vertical strength that is added by the internal partition. Moreover, the diagonal orientation of the upper edges 41 of the wings 33 is valuable in preventing a hang-up of an article 45 being inserted into the compartmented container by automatic filling equipment. The downward, slanting diagonal edges 41 of the wings, if contacted by the bottom edge of the article 45 being inserted, such as a plastic bottle of dishwashing detergent as depicted in FIG. 3, gives the bottle the tendency to slide off the edge and not be hung up thereupon.

Figure 4:
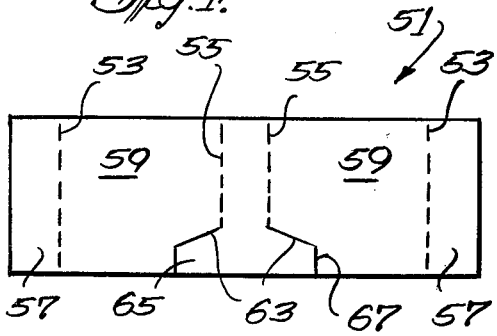
FIG. 4 is a plan view of an alternative version of a die-cut and scored blank for forming an internal partition.

Shown in FIG. 4 is a modified blank 51 which, by comparison with FIG. 1, can be seen to be essentially of a construction equal to the lower half thereof. The blank 51 is die-cut and scored to provide five panels which are defined by four parallel score lines 53 and 55. The panels include a pair of first end panels 57, a pair of transverse panels 59 and a single main panel 61. All of the panels are of the same height, and the transverse panels 59 have a length which is longer than the end panels 57. The main panel 61 is hinged to the transverse panels 59 along the score lines 55 which terminate in diagonal die-cuts 63 which define a pair of wings 65 which are cut from the lower regions of what would otherwise be the transverse panels. The wings 65 similarly terminate in a pair of short vertical edges 67. The end panels 57 are hinged to the transverse panels 59 along the score lines 53.

Figure 5:
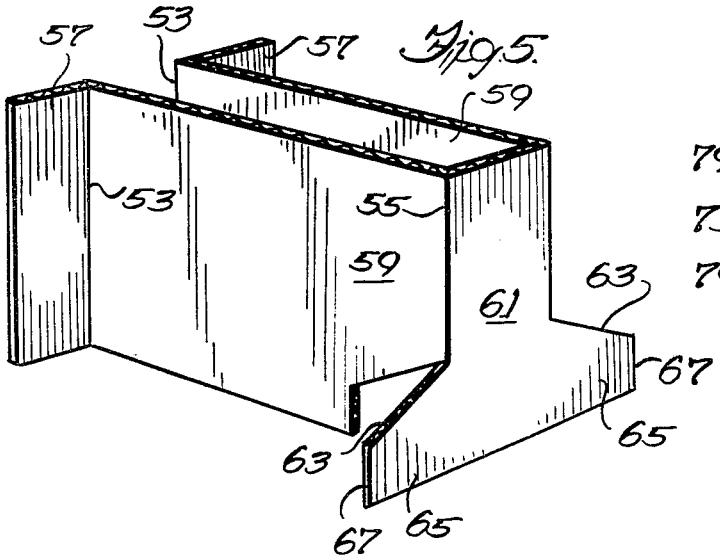
FIG. 5 is a perspective view of a three-cell partition erected from the blank of FIG. 4.
Figure 6:
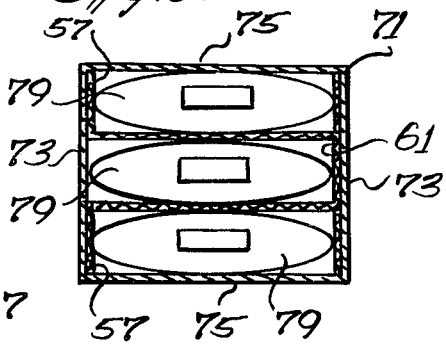
FIG. 6 is a plan view of a rectangular container into which the partition of FIG. 5 has been inserted and then loaded with three objects of equal size and dimension.

When the blank 51 is erected to a partition as depicted in FIG. 5, the resemblence to one-half of the partition as shown in FIG. 2 is quite clear. FIG. 6 shows the partition disposed within a box 71 of rectangular cross section with the main panel 61 lying adjacent the interior surface of one end wall 73 of the box and the two end panels 57 lying adjacent the interior surface of the opposite end wall. Because of the proportioning of the wings 65, being equal in length to the length of the end panels 57, the edges of the transverse panels 59, at the locations where they are hinged to the main panel 61, are located precisely one-third of the distance in from each of the side walls 75 of the box. The resiliency of the corrugated fiberboard causes it to attempt to return to its flat configuration, and the tendency is to press the free edges of the end panels 57 against the side walls 75 of the box and thus precisely position the transverse panels 59 parallel to the side walls, creating three compartments or cells of precisely equal dimension into which automatic loading of a product 79 can be reliably accomplished on a production-lined basis.

Although the invention has been described with regard to certain preferred embodiments which constitute the best mode presently known to the inventor, it should be understood that changes and modifications that would be obvious to one having the ordinary skill in this art may be made without deviating from the scope of the invention that is defined solely by the claims appended hereto. Various features of the invention are emphasized in the claims which follow.

What is claimed is:

1. An internal partition formed from a single sheet of fiberboard material which is divided by score lines and cut lines into ten panels and which defines a plurality of cells of equal dimensions when disposed within a box of rectangular cross section, which partition comprises two pairs of first panels which are respectively hinged together along their upper edges, each pair being located along an opposite edge of said sheet, the length of each of said first panels being equal to one dimension of the cells, said hinge lines being colinear, and said pairs of first panels being spaced apart a distance substantially equal to said length thereof, four transverse panels hinged respectively to a lateral edge of one of said pairs of panels and extending substantially perpendicular thereto, and two main panels each of which is hinged along both of its lateral edges respectively to two of said transverse panels, said main panels being disposed parallel to said two pairs of first panels and having an upper end equal in length to said distance of separation and a lower end equal to about three times the length of said upper end.

2. A partition in accordance with claim 1 wherein said transverse panels each have a length at least equal to the length of said first panels.

3. A partition in accordance with claim 2 wherein the height of all ten of said panels is equal.

4. A partition in accordance with claim 3 wherein said hinge lines along said lateral edges of said main panels extend for a distance equal to at least about one-half of the height thereof and wherein said main panels have diagonal edges extending downward and outward from the lower ends of said lateral hinge lines.

5. A die-cut sheet of corrugated fiberboard which is foldable into the partition of claim 1, which sheet comprises a rectangular blank having a central folding line located equidistant from two parallel edges, the center portion of said central line being a die-cut which terminates equidistantly from both of the other two edges of said blank, said two upper edge hinge lines being located in said central line.

6. A compartmented box which comprises the combination of the partition of claim 1 and a box of rectangular cross section, said two main panels being in surface contact with two opposite walls of said box and the edges of said pairs of first panels being in contact with the other two walls of said box.

7. An internal partition formed from a single sheet of fiberboard material which is divided by score lines and cut lines into five panels and which defines a plurality of cells of equal dimensions when disposed within a box of rectangular cross section, which partition comprises two first panels each having a length equal to one dimension of the cells, said first panels being coplanar and spaced-apart a distance substantially equal to the length thereof, two transverse panels hinged respectively to a lateral edge of one of said first panels and extending substantially perpendicular thereto, said transverse panels having a length at least equal to the length of said first panels and a main panel hinged along both of its lateral edges respectively to said transverse panels, which main panel is disposed parallel to said first panels, said main panel having an upper end equal in length to said spaced-apart distance and a lower end equal to about three times the length of its upper end.

8. A partition in accordance with claim 7 wherein the height of all five of said panels is equal.

9. A partition in accordance with claim 8 wherein hinge lines along said lateral edges of said main panel extend for a distance equal to at least about one-half the height thereof and wherein said main panel has diagonal edges extending downward and outward from the lower ends of said lateral hinge lines.

10. A compartmented box which comprises the combination of the partition of claim 7 and a box of rectangular cross section, said two main panels being in surface contact with two opposite walls of said box and the free edges of said pair of first panels being in contact with the other two walls of said box.

* * * * *